US010156817B2

(12) United States Patent
Anufa et al.

(10) Patent No.: US 10,156,817 B2
(45) Date of Patent: Dec. 18, 2018

(54) LIQUID ELECTROPHOTOGRAPHIC PRINTING

(71) Applicant: HP INDIGO B.V., Amstelveen (NL)

(72) Inventors: Asaf Anufa, Rehovot (IL); Ilan Romem, Ramat Hasharon (IL)

(73) Assignee: HP Indigo B.V., Amstelveen (NL)

( * ) Notice: Subject to any disclaimer, the term of this patent is extended or adjusted under 35 U.S.C. 154(b) by 7 days.

(21) Appl. No.: 15/545,953

(22) PCT Filed: Apr. 13, 2015

(86) PCT No.: PCT/EP2015/057977

§ 371 (c)(1),
(2) Date: Jul. 24, 2017

(87) PCT Pub. No.: WO2016/165736

PCT Pub. Date: Oct. 20, 2016

(65) Prior Publication Data

US 2018/0017898 A1 Jan. 18, 2018

(51) Int. Cl.

| | |
|---|---|
| ***G03G 15/10*** | (2006.01) |
| ***G03G 15/11*** | (2006.01) |
| ***G03G 5/00*** | (2006.01) |
| ***G03G 5/14*** | (2006.01) |
| ***G03G 15/01*** | (2006.01) |
| ***G03G 15/16*** | (2006.01) |

(52) U.S. Cl.

CPC ..... *G03G 15/11* (2013.01); *G03G 5/005* (2013.01); *G03G 5/142* (2013.01); *G03G 15/0157* (2013.01); *G03G 15/161* (2013.01); *G03G 2215/1671* (2013.01); *G03G 2215/1695* (2013.01)

(58) Field of Classification Search

USPC ..... 399/222, 237–240, 249, 250

See application file for complete search history.

(56) References Cited

U.S. PATENT DOCUMENTS

| | | | | |
|---|---|---|---|---|
| 5,276,492 | A | 1/1994 | Landa et al. | |
| 5,300,990 | A | 4/1994 | Thompson | |
| 6,885,839 | B2 * | 4/2005 | Baker | G03G 15/11 399/249 |
| 7,809,307 | B2 * | 10/2010 | Fukumoto | G03G 15/11 399/101 |

(Continued)

FOREIGN PATENT DOCUMENTS

| | | |
|---|---|---|
| GB | 2049488 | 12/1980 |

OTHER PUBLICATIONS

Andrew Tribute, The New Liquid Toner Generation, May 8, 2012 (4 pages).

*Primary Examiner* — Hoan Tran

(74) *Attorney, Agent, or Firm* — HP Inc. Patent Department

(57) ABSTRACT

An example apparatus is provided in accordance with the present disclosure, which may be used for example for liquid electrophotographic printing. The example apparatus includes a photo imaging plate to receive a liquid colorant image, the liquid colorant including a carrier fluid, and to transfer the image to a support, and a rotatable roller to remove carrier fluid from the photo imaging plate and increase the density of solids in the liquid colorant on at least a region of the photo imaging plate, prior to the liquid image being transferred.

18 Claims, 3 Drawing Sheets

(56) References Cited

U.S. PATENT DOCUMENTS

| | | | |
|---|---|---|---|
| 2001/0036374 | A1 | 11/2001 | Chang et al. |
| 2002/0098016 | A1 | 7/2002 | Kurotori et al. |
| 2002/0159801 | A1 | 10/2002 | Nakashima et al. |
| 2003/0133728 | A1 | 7/2003 | Caruthers et al. |
| 2004/0047656 | A1 | 3/2004 | Sakai et al. |

* cited by examiner

LIQUID ELECTROPHOTOGRAPHIC PRINTING

BACKGROUND

In liquid electrophotographic (LEP) printing technologies it is known to use liquid colorant comprising electrically charged colorant particles dispersed in a carrier fluid.

The liquid colorant is used to form an image on a photoconductor surface, and the image is then transferred e.g. to an intermediate transfer member, which is heated to evaporate the carrier fluid.

BRIEF DESCRIPTION

Some non-limiting examples of the present disclosure will be described in the following with reference to the appended drawings, in which.

DETAILED DESCRIPTION

In implementations of liquid electrophotographic printing a photo imaging plate in the form of a photoconductor surface such as a drum-type plate or a flat loop-type belt, is electrically charged and then selectively exposed to light. This selective exposure forms an electrostatic latent image on the photoconductor surface, with the regions exposed to light (image regions) having an electrostatic charge density, and the regions unexposed to light (non-image or background regions) having another, different electrostatic charge density.

Then a liquid colorant containing charged colorant particles dispersed in an insulating carrier fluid is caused to adhere to the photoconductor surface, by generating an electric field between the photoconductor surface and a developer roller. The liquid colorant may be liquid ink, and the colorant particles may be ink particles. The colorant particles are attracted to the regions exposed to light (image regions) and repelled from the regions unexposed to light (non-image or background regions) and therefore the electrostatic latent image is developed to form a visible liquid colorant image on the photoconductor surface.

The liquid colorant layer may then be transferred to an electrically charged blanket of an intermediate transfer member, such as a drum or a belt, with heat being applied to partially melt and blend together the colorant particles, and to evaporate most of the carrier fluid. The result is a hot, nearly dry plastic film, which may be subsequently transferred by contact to a substrate such as paper.

The amount of carrier fluid that is present on the photoconductor surface when the colorant layer is transferred to the intermediate transfer member may have an effect on the print quality: an example may be the appearance of a phenomenon called fog, wherein small empty dots appear in the image in areas having high optical density.

Another effect that may arise when a large amount of carrier fluid is present on the intermediate transfer member is dot gain memory, wherein carrier fluid from one image may remain on the blanket and interact with the carrier fluid of the following image. As a result there may be an increase in dot size, which may distort the colours of the new image.

A high content of carrier fluid may also cause cracks on the image due to shearing when the colorant layer is nipped between the intermediate transfer member and the substrate.

Figure 1:
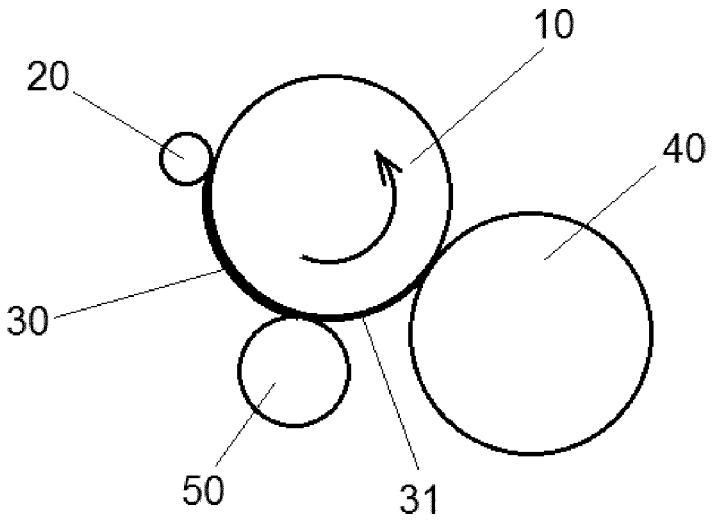
FIG. 1 is a schematic diagram illustrating examples of an apparatus according to implementations disclosed herein.

An example of a liquid electrophotographic printing apparatus as disclosed herein is illustrated in FIG. 1. The apparatus comprises a photo imaging plate 10 (PIP), to receive a liquid colorant image, wherein the liquid colorant that forms the image comprises a carrier fluid. The apparatus also comprises an intermediate transfer member 40 (ITM) to contact the photo imaging plate 10 and to receive the liquid colorant image therefrom. The intermediate transfer member 40 may comprise an electrically chargeable blanket (not shown).

The liquid colorant image may be received on the photo imaging plate 10 for example through a developer roller 20, such as a binary colorant developer, which forms a liquid colorant layer 30 on the photo imaging plate 10. In liquid colorant layer 30 the liquid colorant may comprise a carrier fluid and solids, such as colorant particles, in a certain density.

The layer of carrier fluid received on the photo imaging plate 10 is relatively uniform, but the colorant particles that are dispersed in the layer of carrier fluid tend to concentrate in the image regions, according to the latent electrostatic image, and therefore the density of solids is higher in image regions than in background regions of the liquid colorant image.

Also visible in FIG. 1 is a rotatable roller 50 to remove carrier fluid from the photo imaging plate 10, and therefore to increase the density of solids in the liquid colorant on at least a region of the photo imaging plate 10. The liquid colorant layer on the photo imaging plate 10 after the roller 50, which may have a smaller amount of carrier fluid and a higher density of solids, at least in a region, with respect to the liquid colorant layer before the roller 50, is indicated with reference number 31 in FIG. 1.

In some examples, when the amount of carrier fluid is reduced the density of solids is increased on the image regions of the photo imaging plate 10.

In FIG. 1 it may be seen that the roller 50 removes the carrier fluid prior to the liquid image being transferred to the intermediate transfer member 40. Therefore, the amount of carrier fluid in the liquid colorant image that is received on the intermediate transfer member 40 may be smaller than the amount of carrier fluid in the liquid colorant image that is received by the photo imaging plate 10.

In some implementations this improves the print quality, because it may reduce the appearance of fog and improve image granularity, improve blanket memory and/or reduce the appearance of cracks on the image.

Furthermore, a smaller amount of carrier fluid may be evaporated with less heating, and the drying process on the intermediate transfer member may therefore be more efficient and/or faster.

Figure 2:
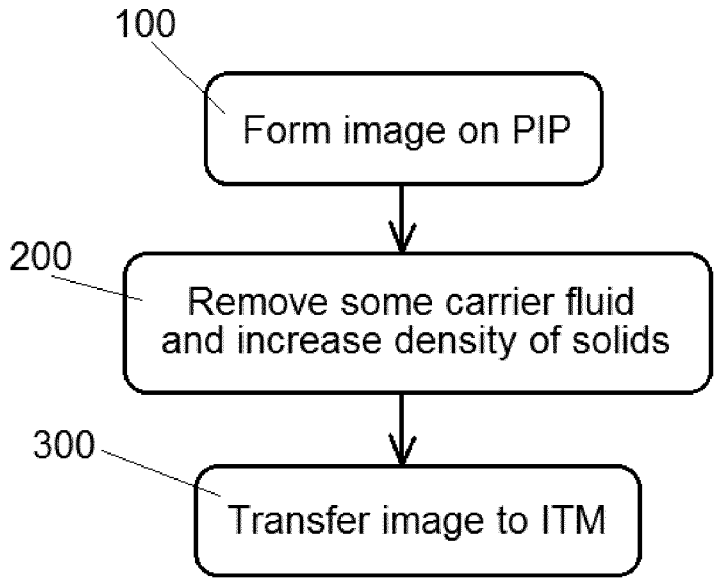
FIG. 2 is a flowchart illustrating examples of a method for liquid electrophotographic printing in accordance with an implementation.

In some examples, as shown in the diagram of FIG. 2, a method for liquid electrophotographic printing comprises in block 100 forming an image on a photo imaging plate (PIP) with liquid colorant comprising a carrier fluid, and in block 200 removing some carrier fluid from the photo imaging plate while increasing the density of solids in the liquid colorant on at least a region of the photo imaging plate, for example on the image regions, before transferring the image to an intermediate transfer member (ITM) in block 300.

Some implementations of the method may be performed by an apparatus as described above with reference to FIG. 1.

Figure 3:
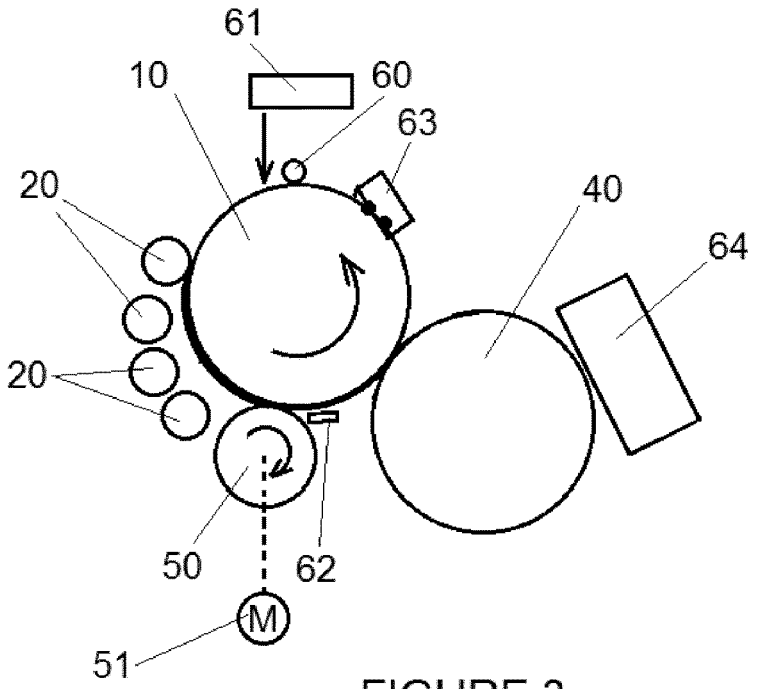
FIGS. 3 and 4 are schematic diagrams illustrating examples of some liquid electrophotographic printing apparatus according to implementations.

Some implementations of a liquid electrophotographic printing apparatus as disclosed herein are illustrated by FIG. 3. The apparatus may comprise a photo imaging plate 10; a number of developer rollers 20 for different colorants, for example black, magenta, cyan and yellow; an intermediate transfer member 40 which may comprise an electrically chargeable blanket; and a rotatable roller 50, as disclosed in relation with FIG. 1.

The apparatus may also comprise in FIG. 3 a charge roller 60 to charge the photo imaging plate 10, a laser writing head 61 to selectively expose the photo imaging plate 10 and form the electrostatic latent image thereon, a pre-transfer erase station 62 to dissipate charges existing on the background regions before the liquid image is transferred to the intermediate transfer member 40, and a cleaning station 63 to remove residual colorant and cool the photo imaging plate 10 after the liquid image is transferred to the intermediate transfer member 40. The blanket on the intermediate transfer member may be heated, and in some implementations there may be an external heating station 64 to evaporate most of the carrier fluid remaining in the liquid colorant, and to cause the colorant particles to partially melt and blend together.

In some implementations of the apparatus, such as in FIG. 1 or FIG. 3, the roller 50 may be pressed against the photo imaging plate 10, and it may squeeze the liquid colorant away therefrom and cause the removal of some of the carrier fluid from the liquid colorant due to capillary forces.

In some implementations the roller 50 has a hardness of between 18 and 57 Shore A, and the force between the roller 50 and the photo imaging plate 10 is in the range of between 50 N/m and 500 N/m.

In some implementations the roller 50 may be driven by its contact with the photo imaging plate 10, and in some implementations a motor 51 may be provided, as shown in FIG. 3, to drive the roller 50 in rotation in a direction opposite to that of the photo imaging plate and set a velocity that allows maintaining the print quality. In some examples the relative velocity between the roller 50 and the photo imaging plate 10 is between −3% and +3%. A suitable value for this relative velocity in order to maintain print quality may be about −1.5%.

In some implementations, removing some carrier fluid comprises applying pressure against the photo imaging plate 10, for example with rotatable roller 50 (FIG. 1), while applying an electric charge to repel colorant particles of the liquid colorant present in image regions of the photo imaging plate 10 and attract colorant particles of the liquid colorant present in background regions of the photo imaging plate 10. The electric charge may be applied through the roller 50.

Colorant particles in image regions of the photo imaging plate 10 may be repelled by the applied electric charge and therefore they may be urged against the photo imaging plate 10 during the removal of carrier oil from the photo imaging plate 10.

The density of solids, for example of colorant particles, in the image regions may therefore increase when carrier oil is removed from the photo imaging plate 10.

On the other hand, colorant particles in background regions of the photo imaging plate 10, which may have a different voltage with respect to the colorant particles in the image regions, may be attracted by the applied electric charge, and therefore they may be removed from the photo imaging plate 10 during the removal of carrier oil from the photo imaging plate 10. These colorant particles may be removed for example towards the roller 50.

In some examples, the roller 50 removes up to 50% of the carrier fluid from the liquid colorant. The density of solids of the liquid colorant in the image regions may simultaneously increase because colorant particles are retained on the photo imaging plate 10, as explained above. The density of solids of the liquid colorant in the background regions may decrease, because colorant particles of the background are attracted by the roller as explained, and removed with the carrier fluid. In some examples, the roller 50 removes an amount of carrier fluid such as to increase the density of solids in the liquid colorant, in average, from about 20% (before the roller 50) to a range of between 25% and 40% (after the roller 50).

Figure 4:
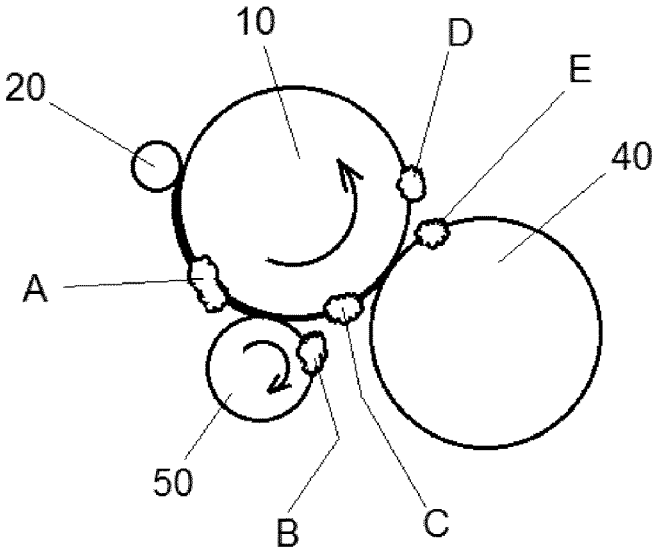

FIG. 4 shows schematically an example of the reduction of carrier fluid in the liquid colorant in apparatus according to implementations disclosed therein. The liquid colorant on the photo imaging plate 10 may contain for example about 80% of carrier fluid and 20% of solids, in average, upstream of the roller 50, in position A. The image regions have a higher density of solids, and the background regions have a lower density of solids.

The roller 50 may remove for example 50% of the carrier fluid (position B), while 50% remains on the photo imaging plate 10 (position C). As a consequence, after the roller 50 the liquid colorant on the photo imaging plate 10 (position C) may contain about 65% of carrier fluid, and about 35% solids, in average.

In the transfer between the photo imaging plate 10 and the intermediate transfer member 40, about 38% of the carrier fluid still present in the liquid colorant may remain on the photo imaging plate 10 (position D), while about 62% may pass on to the intermediate transfer member 40 (position E). The content of carrier fluid on the latter is therefore about 40%, and the contents of solids about 60%, in average.

In some implementations, in order to repel colorant particles of the liquid colorant present in image regions of the photo imaging plate 10, the roller 50 has an electric charge of the same sign as the charge of the colorant particles on the photo imaging plate 10, for example a negative charge.

In order to repel the colorant particles of the liquid colorant present in image regions, while attracting the colorant particles present in background regions, in implementations of the apparatus disclosed herein the absolute value of the voltage of the roller 50 may be higher than the absolute value of the voltage of the colorant particles on image regions, and lower than the absolute value of the voltage of the colorant particles on background regions.

Figure 5:
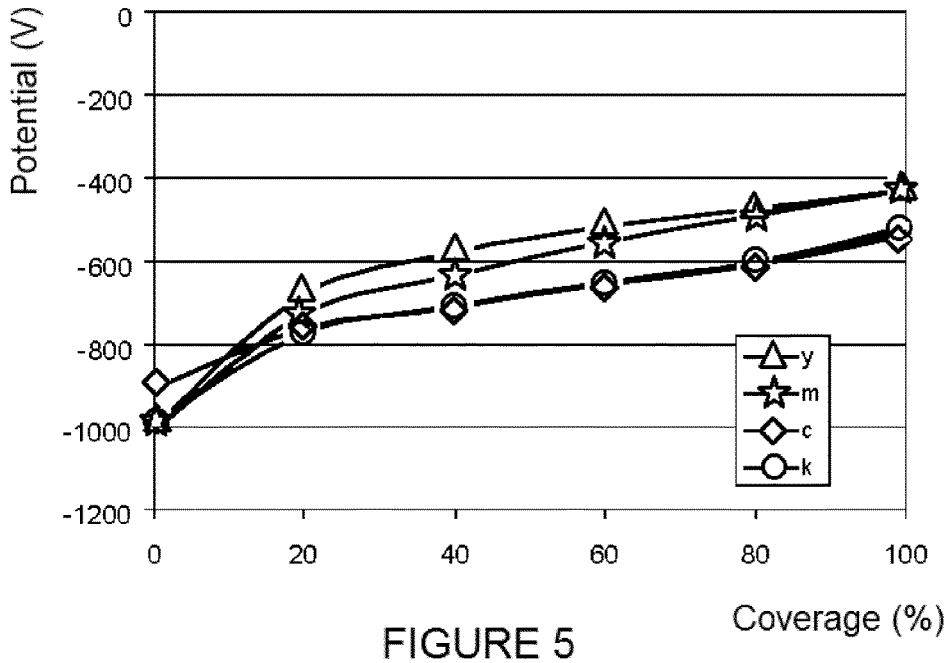
FIG. 5 is a diagram showing the voltage of colorant particles as a function of coverage, in some implementations of an apparatus as disclosed herein.

FIG. 5 illustrates the voltage of black (k), magenta (m), cyan (c) and yellow (y) colorant particles in some implementations of an apparatus as disclosed herein, as a function of the coverage on the photo imaging plate 10. Colorant particles in background regions, i.e. regions with coverage close to 0% because there are few residual charged colorant particles, have a negative voltage of around −900 V, while colorant particles in image regions having a coverage close to 100% have a negative voltage of around −500 V.

In the above example of FIG. 5, the voltage of the roller 50 may be about −800 V in order to repel towards the photo imaging plate 10 the colorant particles on the image regions (at about −500 V), while attracting the residual colorant particles in the background regions (at about −900 V). In some examples the voltage of the roller 50 is between −600 V and −1200 V.

In some implementations the roller 50 is made of conductive rubber, and it may have a resistivity between 0.1 MΩ·cm and 10 MΩ·cm. In some implementations it may have a resistivity between 100 Ω·cm and 1000 Ω·cm.

In implementations of methods and apparatus as disclosed herein, the carrier fluid is removed from roller 50 during operation using a cleaning arrangement, similar to those employed for developers or other rollers.

In some implementations disclosed herein a liquid electrophotographic printing apparatus comprises a photo imaging plate to receive a liquid colorant image, the liquid colorant comprising colorant particles in a carrier fluid, and to transfer the image to a support. The apparatus may further comprise a rotatable roller to remove some carrier fluid and increase the density of colorant particles in the liquid colorant on at least a region of the photo imaging plate, prior to the liquid image being transferred therefrom.

In some implementations, the support to which the image may be transferred from the photo imaging plate may be a printing substrate such as paper, or an intermediate transfer member.

Comparative tests were performed using HP Indigo Digital Press printers, both with and without a charged roller to remove carrier fluid from the photo imaging plate according to implementations disclosed herein, and in several operating conditions. The roller employed in the tests was a rubber roller with a hardness of 37 Shore A and a resistivity of 580 Ω·cm. It was charged at −800 V and rotated at a relative velocity of −1%.

The tests showed improvements in parameters such as fog level, optical density (OD), background on paper (BOP), blanket long term memory (dot gain) and short term memory (STM) when a charged roller was used.

For example, in the comparative tests performed, fog level was reduced between about 5% and about 8%, OD on black was increased between about 2% and about 5%, BOP decreased between about 65% and about 95% for black and between about 75% and about 95% for magenta, dot gain was reduced about 30%, and STM was reduced a variable amount between about 6% and about 50%.

Although a number of particular implementations and examples have been disclosed herein, further variants and modifications of the disclosed devices and methods are possible. For example, not all the features disclosed herein are included in all the implementations, and implementations comprising other combinations of the features described are also possible.

The invention claimed is:

1. A liquid electrophotographic printing apparatus comprising:

a photo imaging plate to receive a liquid colorant image, the liquid colorant comprising a carrier fluid;

an intermediate transfer member to contact the photo imaging plate to receive the liquid colorant image therefrom; and a rotatable roller to remove carrier fluid from the photo imaging plate and increase the density of solids in the liquid colorant on at least a region of the photo imaging plate, prior to the liquid colorant image being transferred to the intermediate transfer member, wherein the roller has an electric charge of the same sign as the charge of colorant particles of the liquid colorant on the photo imaging plate.

2. The apparatus of claim 1, wherein the roller is pressed against the photo imaging plate.

3. The apparatus of claim 2, wherein the force between the roller and the photo imaging plate is in the range of between 50 N/m and 500 N/m.

4. The apparatus of claim 1, wherein the roller has a hardness of between 18 and 57 Shore A.

5. The apparatus of claim 1, wherein the electric charge of the roller is to repel the colorant particles of the liquid colorant on image regions of the photo imaging plate.

6. The apparatus of claim 5, wherein the electric charge of the roller is to attract the colorant particles of the liquid colorant on background regions of the photo imaging plate.

7. The apparatus of claim 1, wherein a voltage of the roller has an absolute value that is higher than that of colorant particles of the liquid colorant on image regions of the photo imaging plate.

8. The apparatus of claim 7, wherein the voltage of the roller has an absolute value that is lower than that of colorant particles of the liquid colorant on background regions of the photo imaging plate.

9. The apparatus of claim 1, wherein the roller is to remove carrier fluid such as to increase the density of solids in the liquid colorant, on average, from about 20% to a range of between 25% and 40%.

10. The apparatus of claim 1, comprising a motor to drive the roller in rotation.

11. A liquid electrophotographic printing apparatus comprising:

a photo imaging plate to receive a liquid colorant image, the liquid colorant comprising a carrier fluid;

an intermediate transfer member to contact the photo imaging plate to receive the liquid colorant image therefrom; and a rotatable roller to remove carrier fluid from the photo imaging plate and increase the density of solids in the liquid colorant on at least a region of the photo imaging plate, prior to the liquid colorant image being transferred to the intermediate transfer member, wherein the roller has a negative electric charge.

12. A liquid electrophotographic printing apparatus comprising:

a photo imaging plate to receive a liquid colorant image, the liquid colorant comprising colorant particles in a carrier fluid, and to transfer the liquid colorant image to a support; and a rotatable roller to remove a portion of the carrier fluid and increase a density of colorant particles in the liquid colorant on at least a region of the photo imaging plate, prior to the liquid colorant image being transferred therefrom, the roller to apply an electric charge to repel colorant particles on an image region of the photo imaging plate.

13. The apparatus of claim 12, wherein the electric charge applied by the roller attracts colorant particles on a background region of the photo imaging plate.

14. The apparatus of claim 13, wherein the electric charge applied by the roller has a same polarity as a charge of the colorant particles on the image region of the photo imaging plate, and has an opposite polarity as a charge of the colorant particles on the background region of the photo imaging plate.

15. The apparatus of claim 12, wherein the electric charge applied by the roller has a same polarity as a charge of the colorant particles on the image region of the photo imaging plate.

16. A method for liquid electrophotographic printing comprising:

forming an image on a photo imaging plate with liquid colorant comprising a carrier fluid; and removing, using a roller, a portion of the carrier fluid from the photo imaging plate while increasing a density of solids in the liquid colorant on an image region of the photo imaging plate, before transferring the image to an intermediate transfer member, the roller applying an electric charge to repel colorant particles on the image region of the photo imaging plate.

17. The method of claim 16, wherein removing the portion of the carrier fluid comprises applying pressure, using the roller, against the photo imaging plate while applying the electric charge.

18. The method of claim 16, wherein the electric charge applied by the roller has a same polarity as a charge of the colorant particles on the image region of the photo imaging plate.

* * * * *